US011643893B2

(12) United States Patent
Scruggs

(10) Patent No.: US 11,643,893 B2
(45) Date of Patent: May 9, 2023

(54) WELL TOOL ANCHOR AND ASSOCIATED METHODS

(71) Applicant: WEATHERFORD TECHNOLOGY HOLDINGS, LLC, Houston, TX (US)

(72) Inventor: Justin R. Scruggs, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 17/850,212

(22) Filed: Jun. 27, 2022

(65) Prior Publication Data

US 2022/0325589 A1 Oct. 13, 2022

Related U.S. Application Data

(62) Division of application No. 15/699,592, filed on Sep. 8, 2017, now Pat. No. 11,421,491.

(51) Int. Cl.

| | |
|---|---|
| ***E21B 29/00*** | (2006.01) |
| ***E21B 23/01*** | (2006.01) |
| ***E21B 23/04*** | (2006.01) |

(52) U.S. Cl.

CPC ..... *E21B 23/01* (2013.01); *E21B 23/04* (2013.01); *E21B 29/00* (2013.01); *E21B 29/002* (2013.01)

(58) Field of Classification Search

CPC ..... E21B 23/00; E21B 23/01; E21B 23/04; E21B 29/00–0005

See application file for complete search history.

(56) References Cited

U.S. PATENT DOCUMENTS 1,867,289 A * 7/1932 Ventresca ..... E21B 29/005 166/55.7
2,180,693 A * 11/1939 Reed ..... E21B 29/005 30/106
2,199,020 A * 4/1940 Barrett ..... E21B 29/005 166/55.7

(Continued)

FOREIGN PATENT DOCUMENTS

EP 0278730 A2 8/1988
WO 2018069683 A1 4/2018

OTHER PUBLICATIONS

Saudi Arabian Examination Report dated Jun. 5, 2022 for SA Patent Application No. 520411479, 6 pages.

(Continued)

*Primary Examiner* — Steven A MacDonald
(74) *Attorney, Agent, or Firm* — Smith IP Services, P.C.

(57) ABSTRACT

An anchor for securing a well tool can include a longitudinally extending central axis, an outwardly extendable grip member, and a mechanical linkage including multiple pivotably connected links. The links pivot relative to each other in a plane laterally offset from the central axis. A method of anchoring a well tool can include flowing a fluid through an anchor connected to the well tool, thereby outwardly extending a grip member into contact with a well surface, and applying a tensile force to the anchor, thereby increasingly biasing the grip member against the well surface and securing the well tool relative to the well surface. A method of anchoring a tubing cutter in a tubular string can include applying a tensile force from an anchor to the tubular string, and cutting the tubular string while the tensile force is applied from the anchor to the tubular string.

8 Claims, 12 Drawing Sheets

(56) References Cited

U.S. PATENT DOCUMENTS

| | | | | | |
|---|---|---|---|---|---|
| 2,202,985 | A * | 6/1940 | Ellis | E21B 29/007 | 166/55.6 |
| 2,203,011 | A * | 6/1940 | Ellis | E21B 29/005 | 30/106 |
| 2,332,749 | A * | 10/1943 | Page | E21B 23/04 | 166/212 |
| 2,435,899 | A * | 2/1948 | Page | E21B 23/04 | 166/212 |
| 2,796,123 | A | 6/1957 | Ellis | | |
| 2,899,000 | A * | 8/1959 | Medders | E21B 29/005 | 166/55.8 |
| 2,991,834 | A * | 7/1961 | Kennard | E21B 29/005 | 166/216 |
| 3,664,417 | A * | 5/1972 | Conrad | E21B 43/10 | 166/216 |
| 4,550,781 | A | 11/1985 | Kagler, Jr. | | |
| 4,776,394 | A | 10/1988 | Lynde et al. | | |
| 5,253,710 | A * | 10/1993 | Carter | E21B 31/16 | 166/55.6 |
| 6,311,778 | B1 | 11/2001 | Carisella et al. | | |
| 6,679,328 | B2 * | 1/2004 | Davis | E21B 29/005 | 175/267 |
| 8,881,818 | B2 * | 11/2014 | Crow | E21B 23/01 | 166/54.5 |
| 8,893,791 | B2 * | 11/2014 | Crow | E21B 31/16 | 166/55.7 |
| 11,078,754 | B2 * | 8/2021 | Telfer | E21B 47/117 | |
| 11,125,036 | B2 * | 9/2021 | Telfer | E21B 33/129 | |
| 11,180,973 | B2 * | 11/2021 | Telfer | E21B 34/12 | |
| 2002/0162659 | A1 * | 11/2002 | Davis | E21B 29/005 | 166/361 |
| 2003/0173076 | A1 | 9/2003 | Sheiretov et al. | | |
| 2005/0211429 | A1 | 9/2005 | Gray et al. | | |
| 2012/0285684 | A1 * | 11/2012 | Crow | E21B 29/005 | 166/54.5 |
| 2012/0292027 | A1 * | 11/2012 | Crow | E21B 29/005 | 166/55.7 |
| 2012/0312549 | A1 * | 12/2012 | Eddison | E21B 29/00 | 166/98 |
| 2013/0048268 | A1 * | 2/2013 | Crow | E21B 31/16 | 166/55.7 |
| 2015/0211312 | A1 | 7/2015 | Krueger, V | | |
| 2016/0215580 | A1 * | 7/2016 | Lehr | E21B 23/01 | |
| 2017/0067305 | A1 | 3/2017 | Robertson et al. | | |
| 2019/0226327 | A1 * | 7/2019 | Telfer | E21B 23/00 | |
| 2019/0257168 | A1 * | 8/2019 | Sunde | E21B 31/16 | |
| 2019/0257193 | A1 * | 8/2019 | Telfer | E21B 23/01 | |
| 2020/0018131 | A1 * | 1/2020 | Telfer | E21B 33/129 | |

OTHER PUBLICATIONS

English Translation of Saudi Arabian Examination Report dated Jun. 5, 2022 for SA Patent Application No. 520411479, 3 pages.
Brazilian Office Action dated Sep. 20, 2022 for BR Patent Application No. BR112020004641, 4 pages.
European Office Action dated Dec. 12, 2022 for EP Patent Application No. 21171584.2-1002, 4 pages.

* cited by examiner

WELL TOOL ANCHOR AND ASSOCIATED METHODS

CROSS-REFERENCE TO RELATED APPLICATION

This application is a division of prior application Ser. No. 15/699,592 filed on 8 Sep. 2017. The entire disclosure of this prior application is incorporated herein by this reference.

BACKGROUND

This disclosure relates generally to equipment utilized and operations performed in conjunction with a subterranean well and, in one example described below, more particularly provides an anchor and associated methods for securing a well tool and a bottom hole assembly in a well.

An anchor can be used to secure a well tool in a desired position in a well. In some situations, the anchor may be required to maintain the well tool or a portion thereof motionless (at least in a longitudinal direction) while a well operation is performed with the well tool (such as, milling, cutting, punching, perforating, etc.).

Therefore, it will be appreciated that improvements are continually needed in the art of constructing and utilizing well tool anchors. Such improvements may be useful in a variety of different well operations.

DETAILED DESCRIPTION

Figure 1:
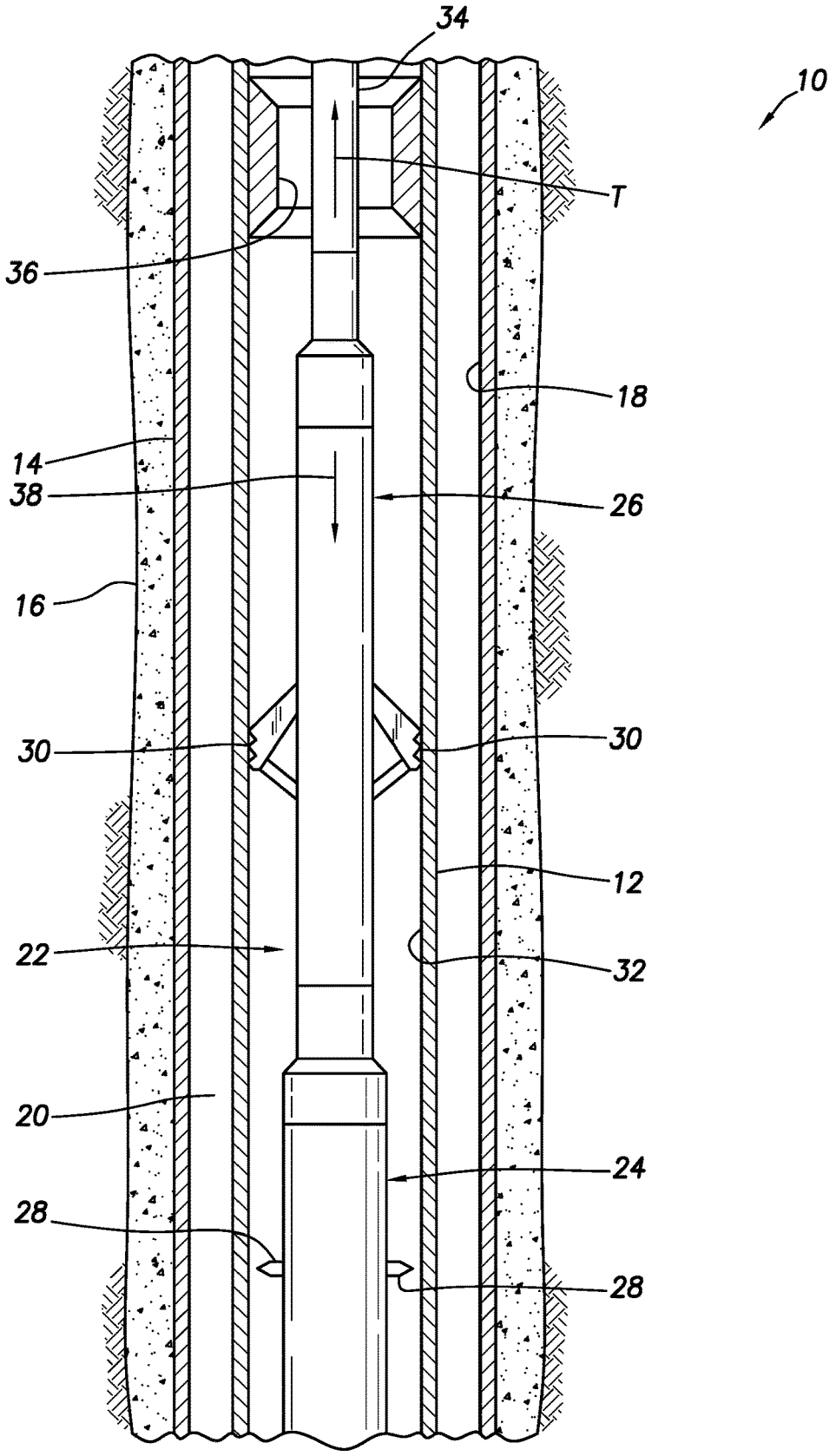
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is positioned within casing 14 and cement 16 lining a generally vertical wellbore 18. In other examples, the wellbore 18 may not be lined with casing 14 or cement, and the wellbore 18 may be generally horizontal or otherwise inclined from vertical.

The tubular string 12 may be of the type known to those skilled in the art as production tubing, or it may be another type of pipe, conduit, casing, liner or tubing. Any type of tubular string may be used in the system 10, in keeping with the scope of this disclosure.

In the method depicted in FIG. 1, it is desired to cut the tubular string 12, so that an upper portion of the tubular string can be retrieved to surface. The tubular string 12 may need to be severed because a lower section of the tubular string has become stuck in the wellbore 18 (due to, for example, accumulation of debris in an annulus 20 between the casing 14 and the tubular string, collapse of the casing against the tubular string, failure to unset a packer connected in the tubular string, etc.). However, the scope of this disclosure is not limited to any particular purpose for performing a well operation using the method.

In order to cut through the tubular string 12, a bottom hole assembly (BHA) 22 is conveyed into the tubular string 12 and positioned in a location at which it is desired to cut the tubular string. The BHA 22 is "bottom hole" in that it is connected at or near a distal or downhole end of a conveyance 34 with which it is deployed into the wellbore 18. It is not necessary for the BHA 22 to be positioned at or near a "bottom" of the wellbore 18 or other hole.

In the FIG. 1 example, the BHA 22 includes at least a well tool 24 and an anchor 26 for securing the well tool in the tubular string 12. The BHA 22 can include a variety of other components and well tools (such as, collar locators and other types of logging or locating devices, adapter subs, valves, motors, centralizers, etc.), and different combinations of components may be used to perform corresponding different well operations. Therefore, the scope of this disclosure is not limited to use of any particular components or well tools, or to any particular combination of components or well tools, in the BHA 22.

The well tool 24 in the FIG. 1 example comprises a conventional tubing cutter. The well tool 24 is provided with one or more cutters 28 that can be operated to cut through a wall of the tubular string 12. In various examples, the cutters 28 may be hydraulically, electrically or otherwise powered.

Note that it is not necessary for the well tool 24 to be a tubing cutter. The well tool 24 could instead comprise a mill, a puncher or a perforator if respective milling, punching or perforating operations are to be performed. Thus, the scope of this disclosure is not limited to any particular type of well tool included in the BHA 24.

It also is not necessary for the well operation to be performed specifically on the tubular string 12. In some examples, the well operation may be performed on the casing 14, cement 16 or other structure in the well. As one example, a structure might be blocking flow or access through the casing 14 or the tubular string 12, and the BHA 24 may be deployed into the casing or tubular string, in order to mill or drill through the structure.

In the FIG. 1 example, the BHA 22 is deployed into the tubular string 12 with the conveyance 34, which comprises a coiled tubing string. The tubing string is "coiled" in that it is substantially continuous and is typically stored on a spool or reel at the surface. However, in other examples, other types of tubing strings, whether or not continuous, and other types of conveyances may be used, in keeping with the scope of this disclosure.

The anchor 26 depicted in FIG. 1 includes grip members 30 that grippingly engage an interior surface 32 of the tubular string 12. The grip members 30 in this example are of the type known to those skilled in the art as "slips" having teeth that bite into the interior surface 32. In other examples, the grip members 30 may otherwise grip the interior surface 32, and the grip members may have friction-enhancing or gripping profiles other than teeth for engaging the tubular string 12. Thus, the scope of this disclosure is not limited to any particular configuration or structure for the grip members 30.

Note that, in the FIG. 1 example, the grip members 30 engage the interior surface 32 at a same longitudinal position along the tubular string 12. This can enhance a stability of the BHA 22 as the well operation is performed.

As depicted in FIG. 1, a restriction 36 is positioned in the tubular string 12 between the surface and the location at which it is desired to cut the tubular string 12. As a result, the BHA 22 is displaced through the restriction 36 when it is deployed to the cutting location. Thus, the anchor 26 must be small enough to pass through the restriction 36, and must be capable of extending the grip members 30 outward sufficiently far to engage the interior surface 32 of the tubular string 12.

An example of the anchor 26 is described below in which the anchor has a capability of extending the grip members 30 outward a relatively large distance, from a relatively compact run-in configuration, so that the anchor is capable of passing through a relatively small restriction and then being set in a tubular string below the restriction. However, it is not necessary for the anchor 26 to pass through the restriction 36, or for the anchor to be capable of extending the grip members 30 any particular distance, in keeping with the scope of this disclosure.

In the FIG. 1 example, the anchor 26 is set by flowing a fluid 38 through the anchor at or above a certain flow rate, in order to extend the grip members 30. A tensile force Tis then applied to the BHA 22 via the conveyance 34 to increasingly bias the grip members 30 outwardly against the interior surface 32. The grip members 30, thus, grippingly engage the tubular string 12 and prevent at least longitudinal displacement of the well tool 24 relative to the tubular string. The grip members 30 may also prevent rotational displacement of the well tool 24 relative to the tubular string 12 (or other interior surface), depending, for example, on a configuration of the grip members.

In other examples, the anchor 26 may be set using other techniques in addition to, or in substitution for, flowing the fluid 38 through the anchor and applying the tensile force T to the anchor. In some examples, the anchor 26 may prevent lateral, radial, rotational or combinations of displacements relative to the tubular string 12 or other structure in the well.

Note that, when the tensile force T is applied to the anchor 26, and the grip members 30 are grippingly engaged with the interior surface 32 of the tubular string 12, the tensile force is transmitted via this gripping engagement to the tubular string. In the FIG. 1 example, this tensile force Tis advantageously applied to the tubular string 12 at the location in which the tubular string is to be cut.

Thus, when the cutters 28 are cutting through the tubular string 12, the tensile force T prevents the upper portion of the tubular string from bearing down on the cutters, causing the cutters to bind, or otherwise damaging the cutters or other portions of the well tool 24. However, it is not necessary in keeping with the scope of this disclosure for the tensile force T to be applied to the tubular string 12 in a location where the tubular string is cut.

Figure 2A:
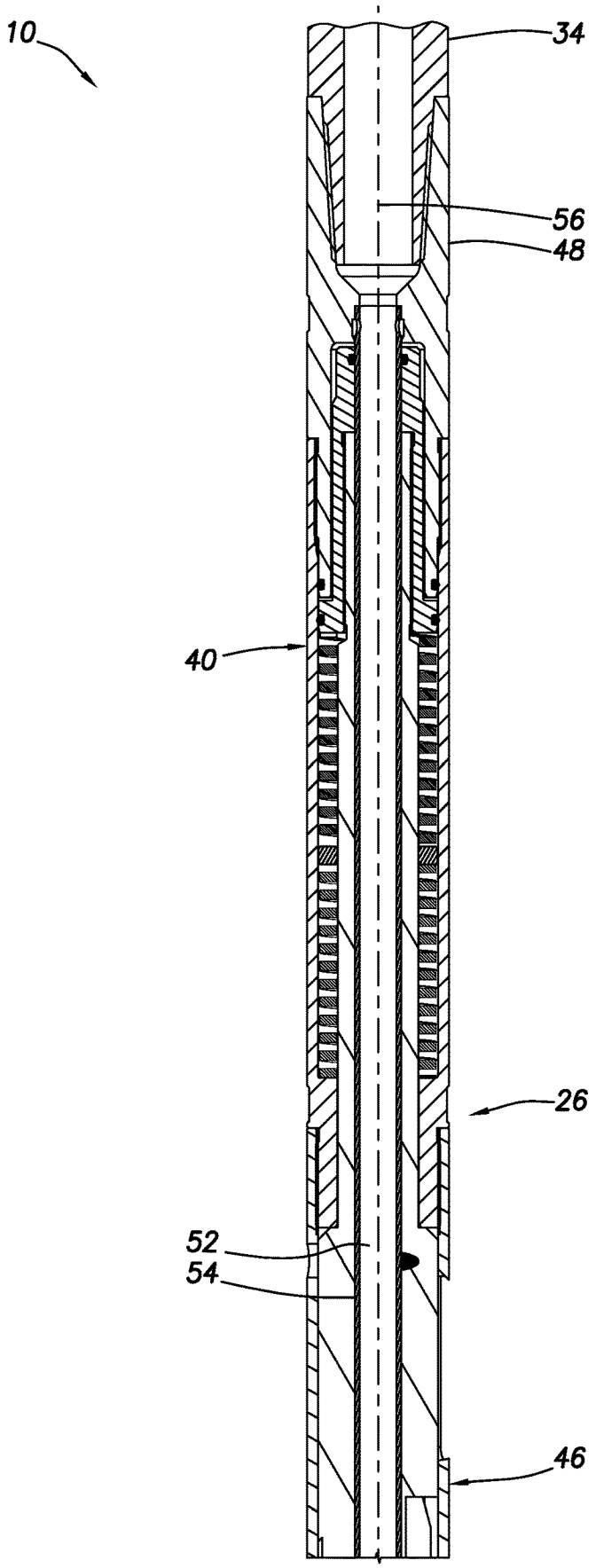
FIGS. 2A & B are representative cross-sectional views of successive axial sections of an example of an anchor that may be used in the well system and method of FIG. 1, and which can embody the principles of this disclosure.
Figure 2B:
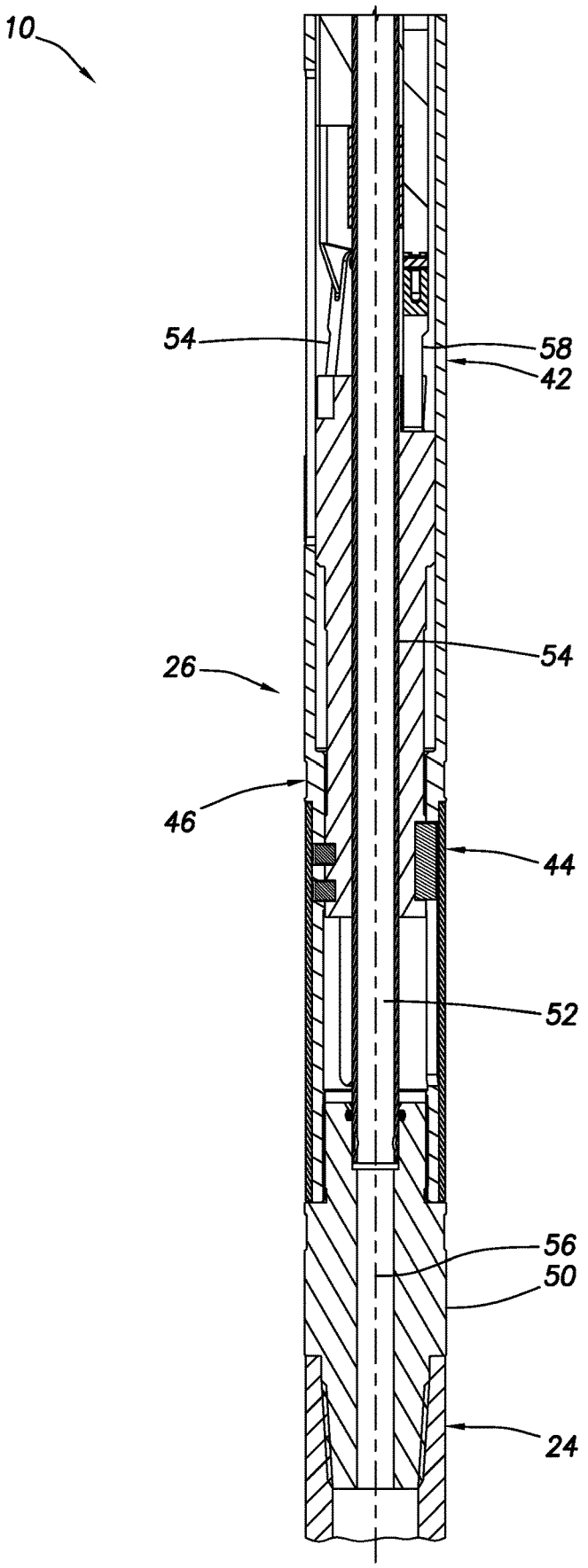

Referring additionally now to FIGS. 2A & B, cross-sectional views of an example of the anchor 26 is representatively illustrated. The anchor 26 is described below as it may be used in the system 10 and method of FIG. 1. However, the anchor 26 of FIGS. 2A & B may be used with other systems and methods, in keeping with the scope of this disclosure.

For clarity, only the conveyance 34, the anchor 26 and the well tool 24 are depicted in FIGS. 2A & B. Note that, in this example, the anchor 26 is connected between the well tool 24 and the conveyance 34. In this manner, the anchor 26 can be used to apply the tensile force T to the tubular string 12 while the well tool 24 is used to cut through the tubular string.

In other examples, the well tool 24 could be connected between the conveyance 34 and the anchor 26, the anchor and/or well tool could be connected between different sections of the conveyance 34, etc. Thus, the scope of this disclosure is not limited to any particular position, location, relative arrangement or configuration of the anchor 26, the well tool 24 or the conveyance 34.

In the FIGS. 2A & B example, the anchor 26 includes an actuator section 40, a grip member section 42 and a contingency release section 44. These sections 40, 42, 44 are identified herein as "sections" merely for convenience in describing the anchor 26 according to functions performed by its components. It is not necessary for the sections 40, 42, 44 to be separate and distinct divisions of the anchor 26, and the anchor may include other or different sections in other examples. Thus, the scope of this disclosure is not limited to use of any particular number, configuration, arrangement or combination of sections in the anchor 26.

An outer housing 46 is connected between upper and lower connectors 48, 50. The upper connector 48 connects the anchor 26 to the conveyance 34. The lower connector 50 connects the anchor 26 to the well tool 24.

A central flow passage 52 extends longitudinally through the conveyance 34, the anchor 26 and the well tool 24 in the FIGS. 2A & B example. A generally tubular inner mandrel 54 encloses the flow passage 52 in the anchor 26 between the upper and lower connectors 48, 50.

A central axis 56 extends longitudinally through the anchor 26. Note that it is not necessary for the central axis 56 to be positioned at precisely a geometric center of the anchor 26. In some examples, the central axis 56 could be offset laterally relative to the geometric center of the anchor 26.

The actuator section 40 is used to extend the grip members 30 (see FIG. 1) of the grip member section 42 outwardly in a preliminary step of setting the anchor 26. When the fluid 38 is flowed through the flow passage 52 at or above a selected flow rate, the actuator section 40 will cause the grip members 30 to extend outward. When the flow rate is subsequently decreased to below the selected flow rate, the actuator section 40 will cause the grip members 30 to retract inward.

The grip member section 42 houses the grip members 30 and includes mechanical linkages 58 that displace the grip members inward or outward in response to forces exerted by the actuator section 40. When the grip members 30 are retracted, they are recessed relative to the outer housing 46, so that they are protected during conveyance into and out of the wellbore 18.

The contingency release section 44 is used to allow unsetting of the anchor 26 in the event that a "normal" unsetting procedure does not accomplish unsetting of the anchor. In this example, the normal unsetting procedure is to relieve the tensile force T applied to the anchor 26 via the conveyance 34 (e.g., by slacking off on the conveyance at the surface), and reduce the flow rate of the fluid 38 through the flow passage 52, thereby causing the actuator section 40 to retract the grip members 30.

Figure 3A:
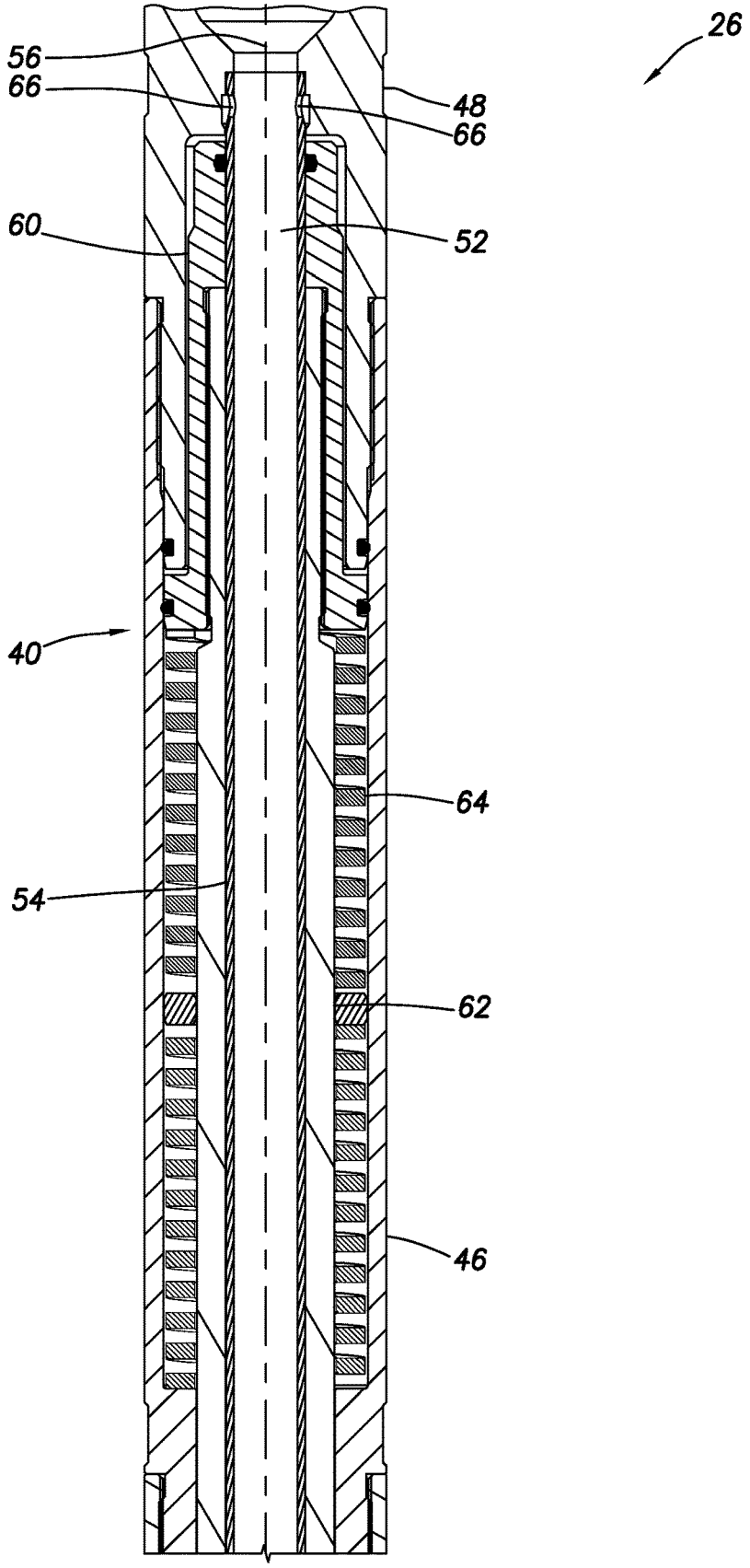
FIGS. 3A-C are representative cross-sectional views of actuator, grip member and contingency release sections of the anchor in a run-in configuration.
Figure 3B:
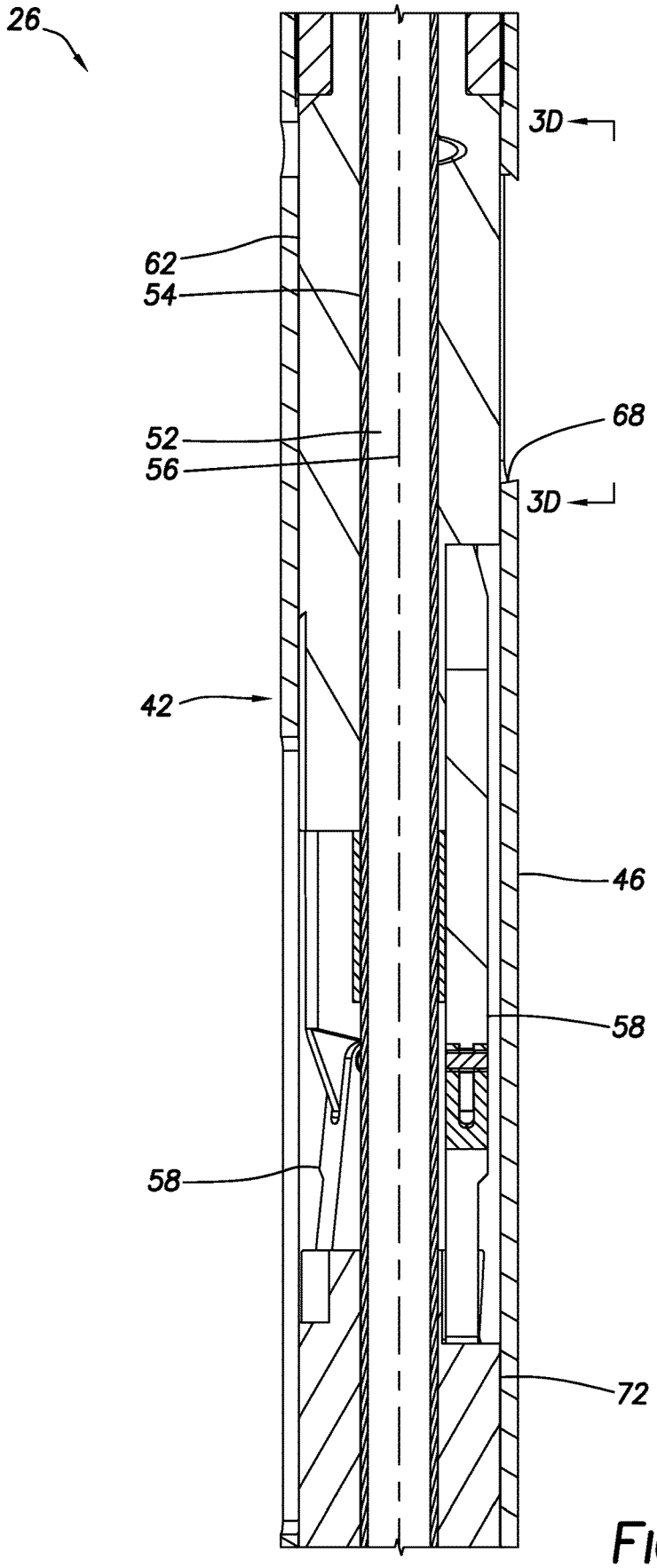
Figure 3C:
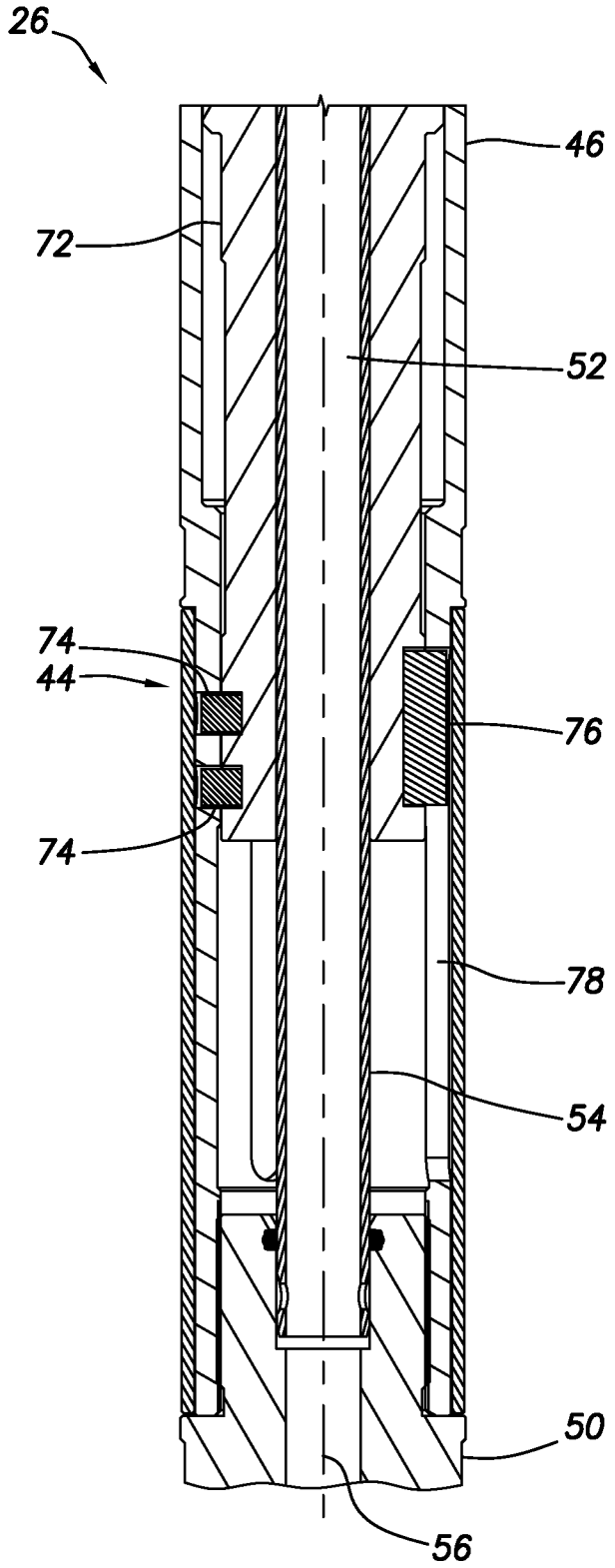

Referring additionally now to FIGS. 3A-C, the respective actuator, grip member and contingency release sections 40, 42, 44 are representatively illustrated in a run-in configuration. In this configuration, the anchor 26 can be conveyed into the tubular string 12 by the conveyance 34, with the grip members 30 retracted. The run-in configuration can also be considered as an "unset" configuration, since the anchor 26 is not secured against longitudinal displacement relative to the tubular string 12.

In FIG. 3A, it may be seen that, in this example, the actuator section 40 includes an annular piston 60 sealingly received between the inner mandrel 54 and the outer housing 46. The piston 60 is connected to an actuator sleeve 62 extending downwardly to the grip member section 42. The piston 60 and actuator sleeve 62 are biased upward by a biasing device 64 (such as, a coiled compression spring, a compressed gas chamber, a resilient material, etc.).

An upper side of the piston 60 is exposed to fluid pressure in the flow passage 52 via ports 66 in the inner mandrel 54. A lower side of the piston 60 is exposed to fluid pressure on an exterior of the anchor 26, for example, via an alignment slot 68 (see FIGS. 3B & D) formed in the outer housing 46.

Thus, when pressure in the flow passage 52 is greater than pressure on the exterior of the anchor 26, this pressure differential is applied across the piston 60, and the piston and actuator sleeve 62 are biased downward against an upwardly directed force exerted by the biasing device 64. When the downward force exerted due to the pressure differential across the piston 60 exceeds the upward biasing force exerted by the biasing device 64, the piston and actuator sleeve 62 will displace downward. If the downward force exerted due to the pressure differential across the piston 60 is subsequently reduced (for example, by reducing the pressure differential), so that it is exceeded by the upward biasing force exerted by the biasing device 64, the piston and the actuator sleeve 62 will displace upward to the FIG. 3A run-in and unset configuration.

Pressure in the flow passage 52 can be increased relative to pressure on the exterior of the anchor 26 by increasing a flow rate of the fluid 38 (see FIG. 1) through the flow passage 52. The fluid 38 will flow from the flow passage 52 to the exterior of the anchor 26 (such as, via the well tool 24 or other flow path). Fluid friction and/or a suitably configured orifice in the flow path between the flow passage 52 and the exterior of the anchor 26 will result in the pressure in the flow passage being greater than the pressure on the exterior of the anchor.

Figure 3D:
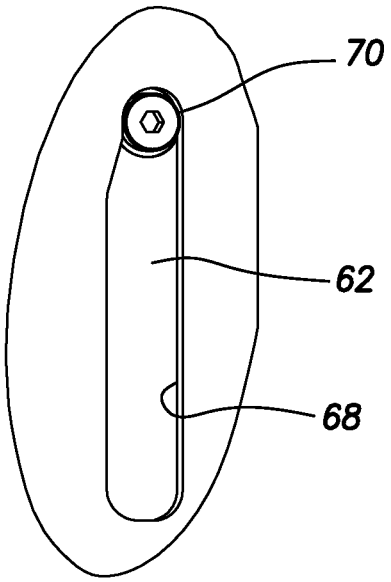
FIG. 3D is a side view of an alignment device of the grip member section, viewed from line 3D-3D of FIG. 3B.

In FIG. 3B, it may be seen that the grip member section 42 includes the linkages 58 used to displace the grip members 30 (not visible in FIG. 3B, see FIGS. 4B & 5) between their extended and retracted positions. The linkages 58 (specifically, the links 58*a*) are connected to the actuator sleeve 62. A fastener 70 (see FIG. 3D) or other projection attached to the actuator sleeve 62 extends outward into longitudinally sliding engagement with the alignment slot 68 formed in the outer housing 46. In this manner, rotational alignment is maintained between the outer housing 46 and the actuator sleeve 62, while permitting longitudinal displacement of the actuator sleeve relative to the outer housing.

When the actuator sleeve 62 displaces downward, the connected linkages 58 extend outward. When the actuator sleeve 62 subsequently displaces upward, the connected linkages 58 retract inward. As described more fully below, the linkages 58 are configured in a manner that provides for a relative large distance of extension and retraction of the grip members 30.

Lower ends of the linkages 58 are connected to a support sleeve 72. The support sleeve 72 supports the lower ends of the linkages 58, with relative longitudinal displacement between the support sleeve and the outer housing 46 being prevented during the setting procedure.

Thus, when the actuator sleeve 62 displaces downward, the linkages 58 are longitudinally compressed between the actuator sleeve and the support sleeve 72, thereby extending the grip members 30 outward. When the actuator sleeve 62 displaces upward, the linkages 58 are longitudinally extended between the actuator and support sleeves 62, 72, thereby inwardly retracting the grip members 30.

In FIG. 3C, it may be seen that the contingency release section 44 includes shear members 74 (such as, shear screws, shear pins, a shear ring, etc.) that releasably secure the support sleeve 72 relative to the outer housing 46. The shear members 74 will shear and thereby permit the outer housing 46 to displace upward relative to the support sleeve 72 if a sufficient upwardly directed tensile force T is applied to the anchor 26 (such as, via the conveyance 34). In other examples, the shear members 74 could be replaced by other types of releasable attachments, latches, collets, snap rings, etc.

An alignment key 76 that displaces with the support sleeve 72 is in longitudinally sliding engagement with an alignment slot 78 in the outer housing 46. Thus, rotational alignment between the support sleeve 72 (and the connected linkages 58) is maintained by the alignment key and slot 76, 78, while longitudinal displacement of the outer housing 46 relative to the support sleeve 72 is permitted after the shear members 74 are sheared.

Note that the tensile force T sufficient to shear the shear members 74 would only be applied in this example if the anchor 26 is set in the well, and cannot subsequently be unset by the normal procedure of reducing the flow rate through the passage 52 and relieving the tensile force T previously applied to set the anchor. In such situations, the tensile force T can be increased to a sufficient level to shear the shear members 74 and unset the anchor 26 in a contingency release operation, described more fully below.

Figure 4A:
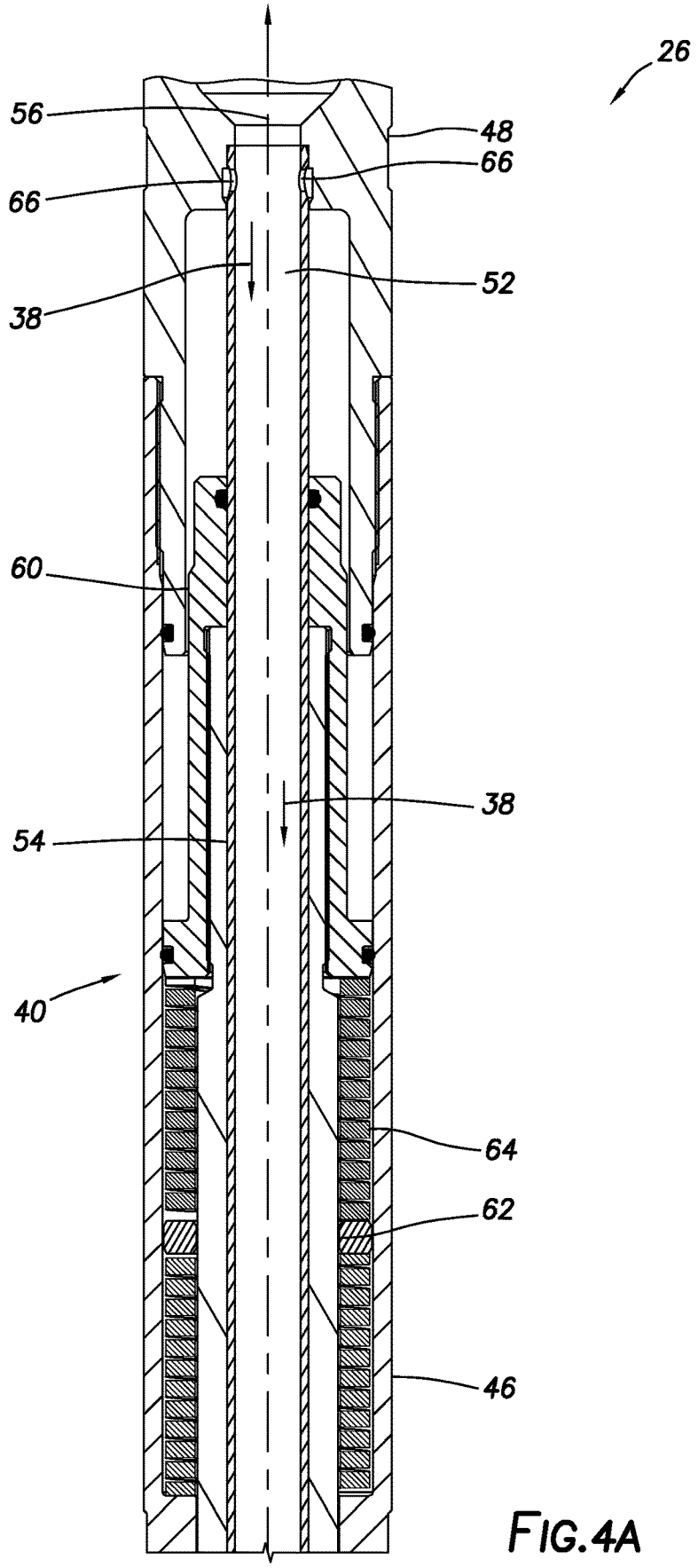
FIGS. 4A-C are representative cross-sectional views of the actuator, grip member and contingency release sections of the anchor in a set configuration.
Figure 4B:
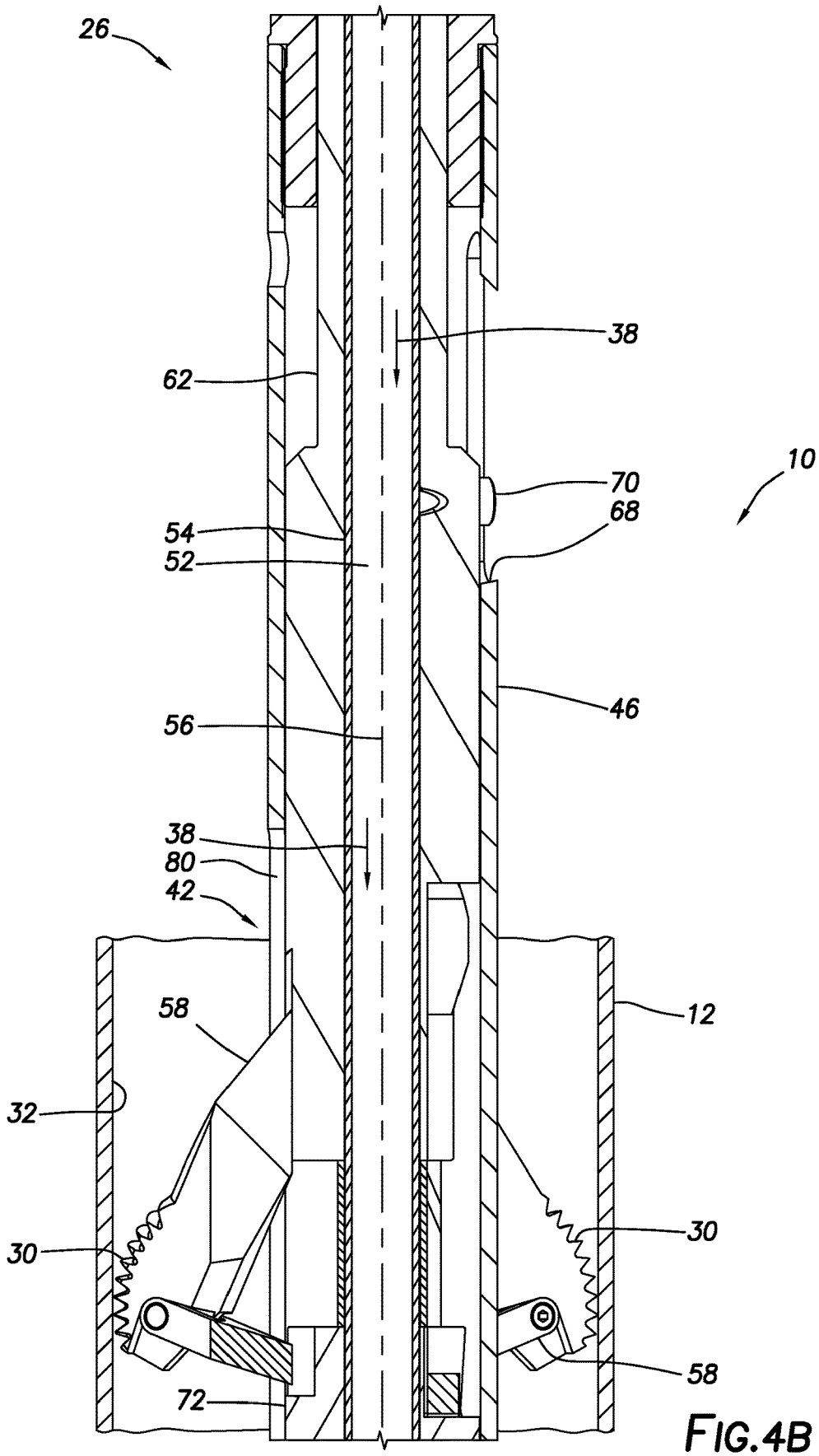
Figure 4C:
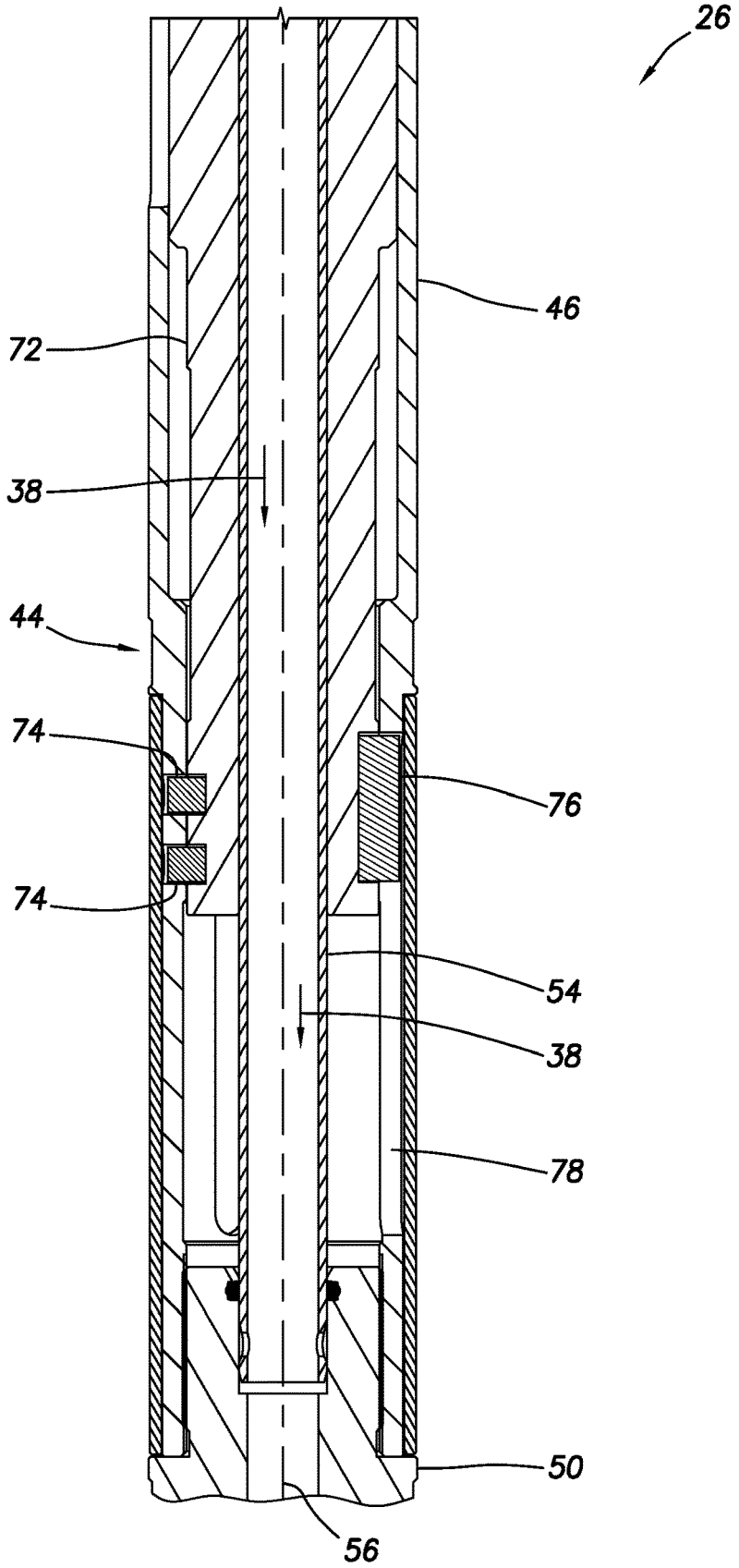

Referring additionally now to FIGS. 4A-C, the anchor 26 sections 40, 42, 44 are representatively illustrated in a set configuration, in which the grip members 30 are engaged with the tubular string 12, so that relative longitudinal displacement of the anchor relative to the tubular string is prevented. If the anchor 26 is used in systems and methods other than the FIG. 1 system 10 and method, the grip members 30 may engage another tubular string (such as, a casing, pipe, conduit, tubing, liner, etc.), another type of tubular, or an interior surface of an earth formation penetrated by a wellbore. Thus, the scope of this disclosure is not limited to engagement between the grip members 30 and any particular structure in a well.

In FIG. 4A, it may be seen that, as the flow rate of the fluid 38 through the flow passage 52 increases, the pressure differential across the piston 60 increases, and the piston and actuator sleeve 62 are increasingly biased downward. When a predetermined flow rate is achieved, the piston 60 and actuator sleeve 62 are displaced downward, and the biasing device 64 is compressed. This downward displacement of the actuator sleeve 62 causes the linkages 58 to outwardly extend the grip members 30.

In FIG. 4B, it may be seen that, with the actuator sleeve 62 downwardly displaced as described above, the linkages 58 are longitudinally compressed between the actuator and support sleeves 62, 72. This longitudinal compression of the linkages 58 displaces the grip members 30 outward into contact with the interior surface 32 of the tubular string 12.

With the grip members 30 contacting the interior surface 32 of the tubular string 12, the upwardly directed tensile force T applied to the anchor 26 will cause the linkages 58 to increasingly bias the grip members 30 against the interior surface. In this manner, the grip members 30 will "bite into" or otherwise increasingly grip the interior surface 32.

In other examples, the grip members 30 may not bite into the interior surface 32 in response to application of the tensile force T. In some examples, the grip members 30 could engage a suitable profile in the tubular string 12 or otherwise contact the tubular string in a manner that secures the anchor 26 against longitudinal displacement relative to the tubular string.

In FIG. 4C, it may be seen that the contingency release section 44 remains in the same configuration as depicted in FIG. 3C. Thus, the support sleeve 72 continues to support the lower ends of the linkages 58 while the anchor 26 is set in the tubular string 12.

Figure 5:
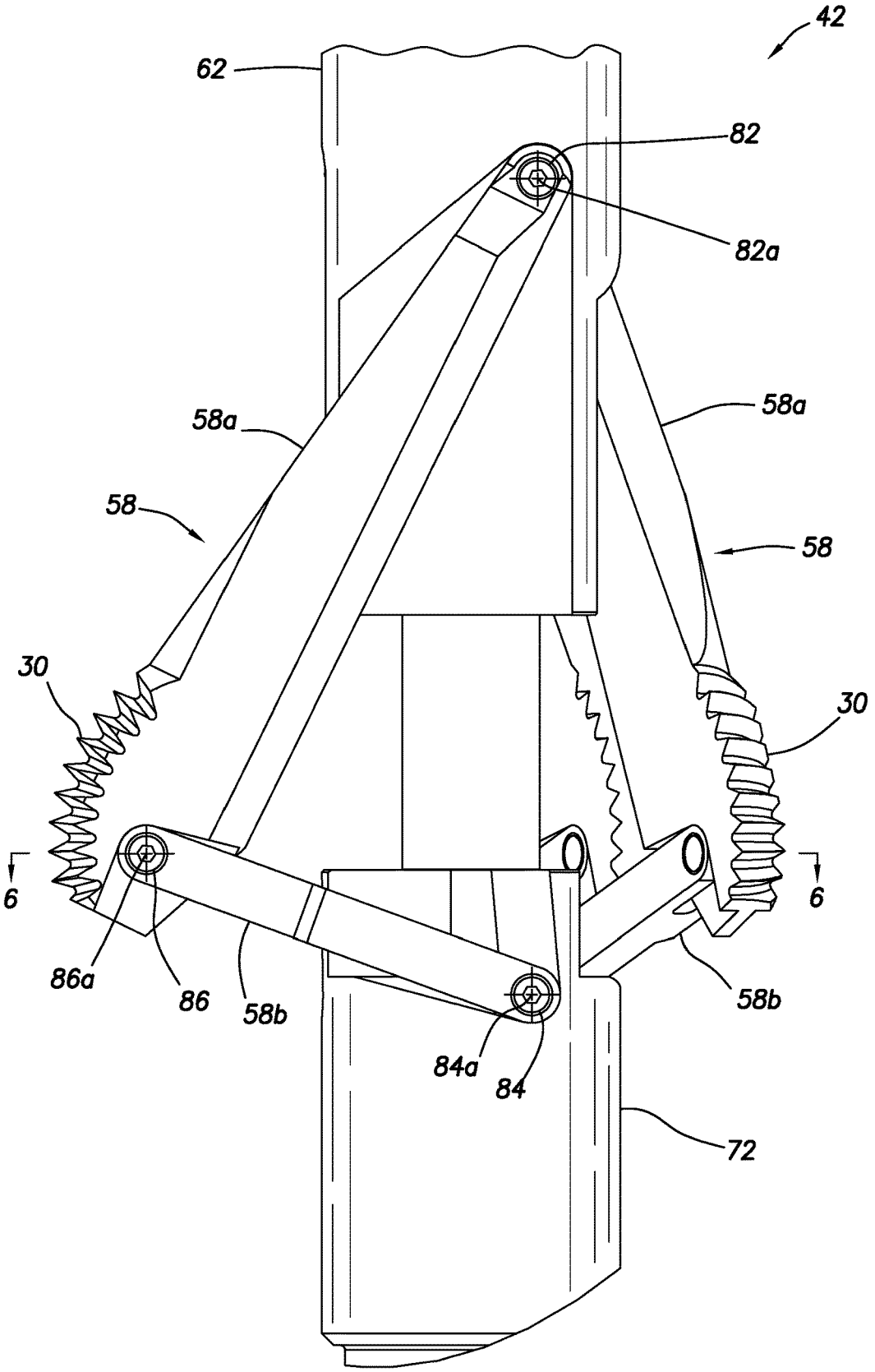
FIG. 5 is a representative side view of a portion of the grip member section in the set configuration.

Referring additionally now to FIG. 5, a portion of the grip member section 42 is representatively illustrated in the set configuration. The outer housing 46 is not shown in FIG. 5 for clarity, but in the set configuration the linkages 58 and grip members 30 extend outwardly through windows or openings 80 formed in the outer housing 46 (see FIGS. 4B & 6).

In the FIG. 5 example, the grip member section 42 includes three sets of linkages 58 and grip members 30 evenly spaced circumferentially about the grip member section. Other numbers and configurations of the linkages 58 and grip members 30 may be used in other examples.

Each of the linkages 58 includes multiple arms or links 58*a,b* pivotably connected to each other and to the actuator and support sleeves 62, 72. More specifically, an upper link 58*a* of each linkage 58 is pivotably connected to the actuator sleeve 62 at a pivot 82 having a pivot axis 82*a*, a lower link 58*b* of each linkage is pivotably connected to the support sleeve 72 at a pivot 84 having a pivot axis 84*a*, and the links 58*a,b* are pivotably connected to each other at a pivot 86 having a pivot axis 86*a*. The pivot axes 82*a*, 84*a*, 86*a* are parallel to each other.

Thus, the links 58*a,b* of each linkage 58 form a type of "scissors" arrangement, in which longitudinal compression of the linkage results in the pivot 86 being displaced outward, and in which longitudinal extension of the linkage results in the pivot 86 being displaced inward. In the FIG. 5 example, the grip member 30 is integrally formed on the upper linkage link 58*a* near the pivot 86, so that the grip member displaces inward and outward with the pivot 86.

However, in other examples, the grip member 30 may be separately formed from the linkage links 58*a,b* and/or may be otherwise positioned relative to the links. The linkage 58 may include different numbers, combinations or configurations of links, and may not be in a scissors arrangement. Thus, the scope of this disclosure is not limited to the details of the linkages 58 as described herein or depicted in the drawings.

Figure 6:
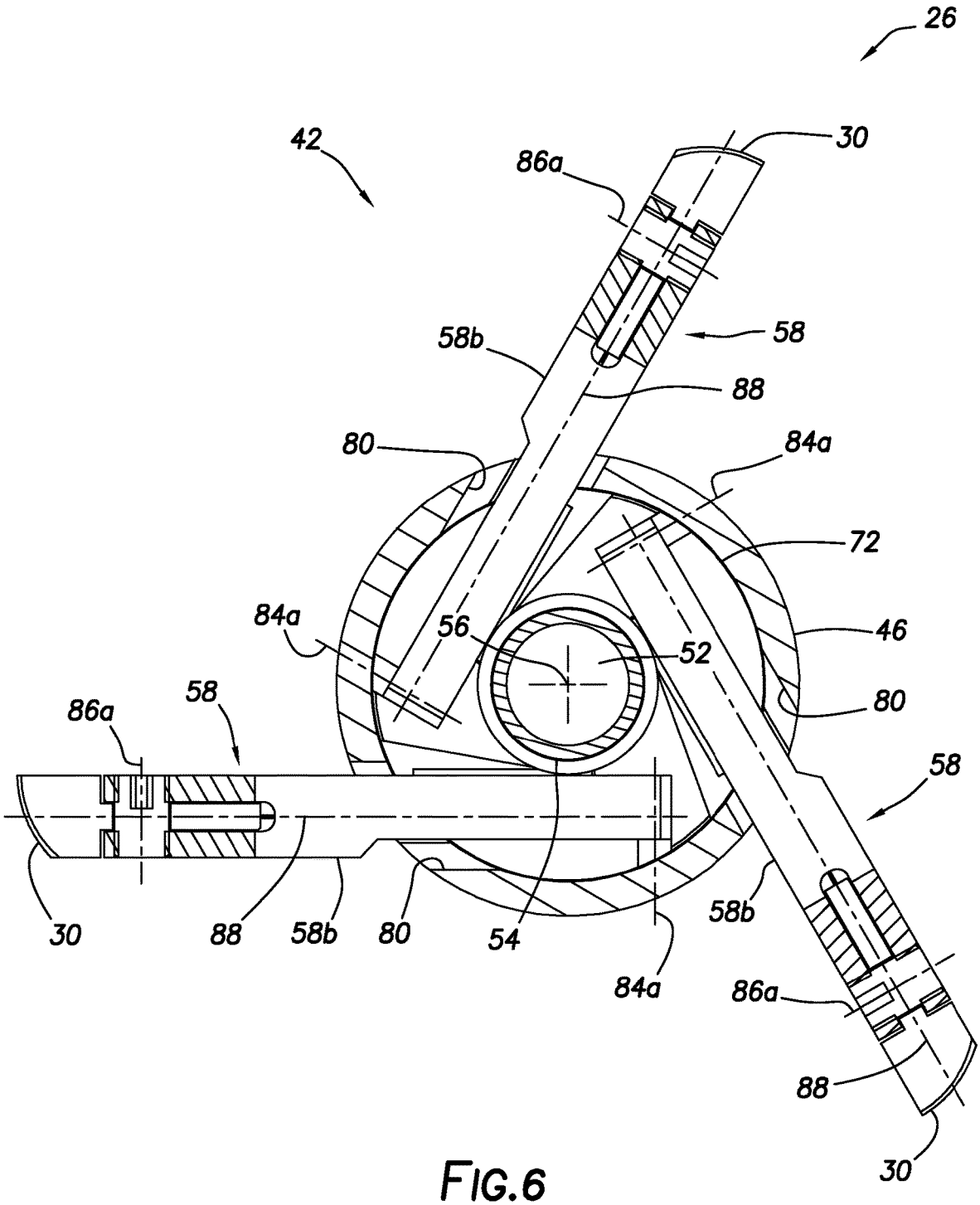
FIG. 6 is a representative cross-sectional view of the grip member section, taken along line 6-6 of FIG. 5.

Referring additionally now to FIG. 6, a cross-sectional view of the grip member section 42 is representatively illustrated, taken along line 6-6 of FIG. 5. In this view, it may be seen that the linkages 58 are distributed circumferentially about, but are laterally offset relative to, the central axis 56. This feature enables the linkages 58 to extend farther outward in response to longitudinal compression than if the linkages were aligned with the central axis 56.

In the FIG. 6 example, the linkages 58 do not lie in planes that intersect the central axis 56. Instead, each set of the links 58*a,b* pivot in a plane 88 that is laterally offset relative to the central axis 56.

In the set configuration depicted in FIG. 6, the central axis 56 is positioned between each set of the pivots 84*a*, 86*a*. The central axis 56 can also be positioned between each set of the pivots 82*a*, 86*a* (for example, if the pivots 82*a* are similarly positioned relative to the pivots 86*a* as the pivots 84*a*, as depicted in FIG. 5).

Figure 7:
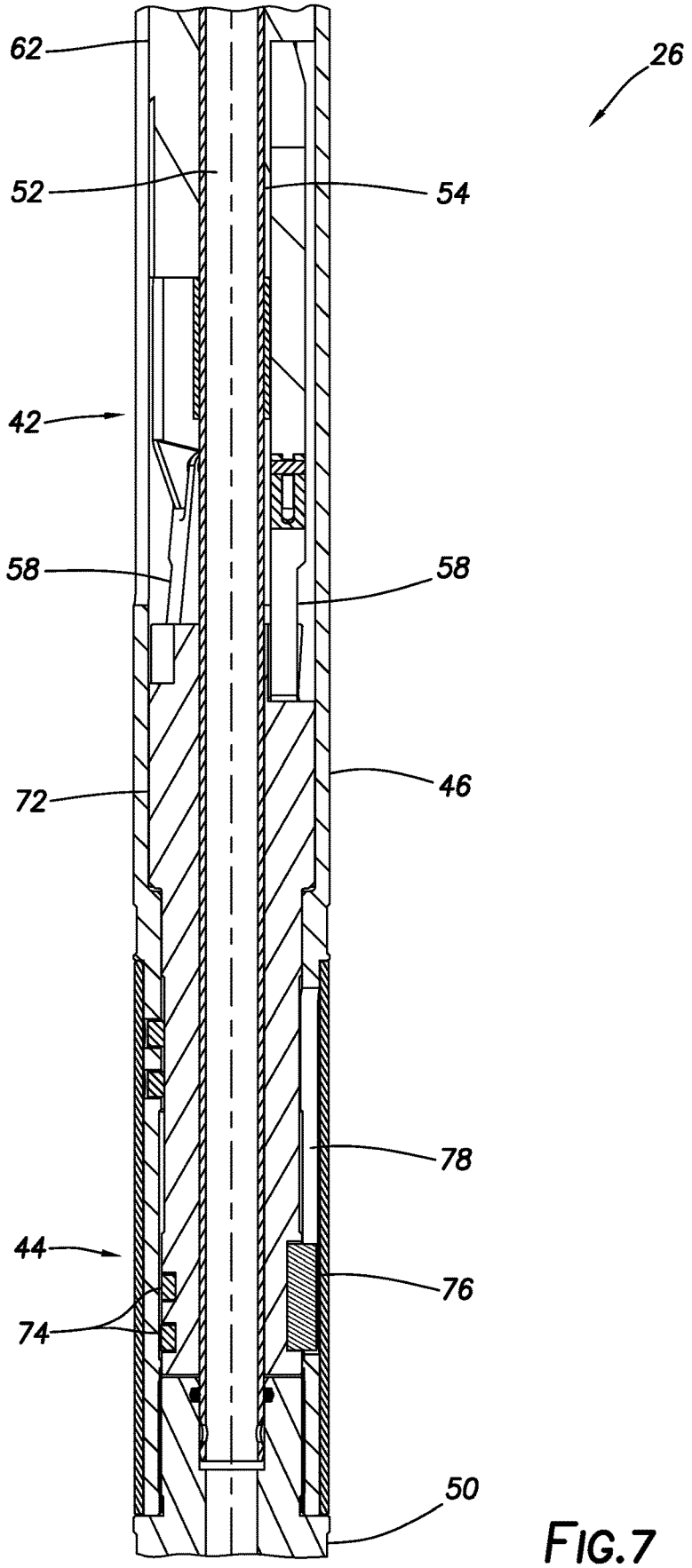
FIG. 7 is a representative cross-sectional view of the grip member and contingency release sections in a contingency released configuration.

Referring additionally now to FIG. 7, the grip member and contingency release sections 42, 44 are representatively illustrated after the contingency release operation has been performed to unset the anchor 26. In this configuration, the tensile force T applied to the anchor 26 has been increased to a level sufficient to shear the shear members 74.

The outer housing 46 has displaced upward relative to the support sleeve 72 (the support sleeve can also displace downward relative to the outer housing 46), so that the linkages 58 are longitudinally extended. This longitudinal extension of the linkages 58 causes the grip members 30 to be retracted inward and out of engagement with the tubular string 12. The BHA 22 and conveyance 34 (see FIG. 1) can now be retrieved from the well to the surface.

It may now be fully appreciated that the above disclosure provides significant advancements to the art of constructing and utilizing anchors for securing well tools in wells. In examples described above, the anchor 26 is provided with grip members 30 that can be extended a relatively large distance outward into engagement with the interior surface 32 of the tubular string 12, the anchor is set with a pressure differential and a tensile force T applied to the anchor, and the anchor can be unset with a contingency release procedure.

The above disclosure provides to the art an anchor 26 for securing a well tool 24 in a subterranean well. In one example, the anchor 26 can comprise a longitudinally extending central axis 56, at least one outwardly extendable grip member 30, and at least one mechanical linkage 58 including multiple pivotably connected links 58*a,b* for displacing the grip member 30. The links 58*a,b* pivot relative to each other in a plane 88 laterally offset from the central axis 56.

The links 58*a,b* may be pivotably connected at multiple pivot axes 82*a*, 84*a*, 86*a*, with the central axis 56 positioned between the pivot axes 82*a*, 84*a*, 86*a*. The links 58*a,b* may be laterally offset from the central axis 56.

The "at least one" grip member 30 may comprise multiple grip members 30. The multiple grip members 30 may be positioned at a same longitudinal position along the central axis 56.

A flow passage 52 may extend longitudinally through the anchor 26. The central axis 56 may be positioned in the flow passage 52.

The grip member 30 may extend outward in response to a fluid flow rate increase through a longitudinal flow passage 52 of the anchor 26. The grip member 30 may retract inward in response to a decrease in the fluid flow rate through the longitudinal flow passage 52.

One of the links 58*b* may be supported by a support structure (such as support sleeve 72). The support structure 72 may be releasably secured relative to a housing 46. Relative longitudinal displacement between the support structure 72 and the housing 46 may be permitted in response to a predetermined force T applied to the housing 46.

A method of anchoring a well tool 24 in a subterranean well is also provided to the art by the above disclosure. In one example, the method can comprise: flowing a fluid 38 through an anchor 26 connected to the well tool 24, thereby outwardly extending at least one grip member 30 of the anchor 26 into contact with a well surface 32; and applying a tensile force T to the anchor 26, thereby increasingly biasing the grip member 30 against the well surface 32 and securing the well tool 24 relative to the well surface 32.

The tensile force T applying step may include applying the tensile force T from the anchor 26 to a tubular string 12 surrounding the anchor 26.

The method may include cutting the tubular string 12 while the tensile force T is applied from the anchor 26 to the tubular string 12.

The fluid 38 flowing step may include creating a pressure differential across a piston 60 of the anchor 26. The piston 60 may be connected to at least one mechanical linkage 58. The grip member 30 outwardly extending step may include the mechanical linkage 58 outwardly extending the grip member 30 in response to the pressure differential creating step.

Links 58*a,b* of the mechanical linkage 58 may pivot in a plane 88 that is laterally offset relative to a central longitudinal axis 56 of the anchor 26.

The method may include decreasing flow of the fluid 38 through the anchor 26, thereby inwardly retracting the grip member 30.

The method may include inwardly retracting the grip member 30 in response to increasing the tensile force T to a predetermined level.

The "at least one" grip member 30 may comprise multiple grip members 30, and the outwardly extending step may include the multiple grip members 30 contacting the well surface 32 at a same longitudinal location along the well surface 32.

A method of anchoring a tubing cutter 24 in a tubular string 12 in a subterranean well is also described above. In one example, the method can comprise: connecting an anchor 26 to the tubing cutter 24; deploying the anchor 26 and the tubing cutter 24 into the tubular string 12; applying a tensile force T from the anchor 26 to the tubular string 12; and cutting the tubular string 12 while the tensile force T is applied from the anchor 26 to the tubular string 12.

The tensile force T applying step may include increasingly biasing at least one grip member 30 of the anchor 26 against an interior surface 32 of the tubular string 12.

The method may include flowing a fluid 38 through the anchor 26, thereby outwardly extending at least one grip member 30 from the anchor 26 into contact with the tubular string 12.

The method may include inwardly retracting the grip member 30 in response to a decrease in flow of the fluid 38 through the anchor 26.

The fluid flowing step may include creating a pressure differential across a piston 60 of the anchor 26. The piston 60 may be connected to at least one mechanical linkage 58, and the grip member 30 outwardly extending step may include the mechanical linkage 58 outwardly extending the grip member 30 in response to the pressure differential creating step.

Links of the mechanical linkage 58 may pivot in a plane 88 that is laterally offset relative to a central longitudinal axis 56 of the anchor 26.

The method may include inwardly retracting the grip member 30 in response to increasing the tensile force T to a predetermined level.

The "at least one" grip member 30 may comprise multiple grip members 30. The outwardly extending step may include the multiple grip members 30 contacting the tubular string 12 at a same longitudinal location along the tubular string 12.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of anchoring a tubing cutter in a tubular string in a subterranean well, the method comprising:

connecting an anchor to the tubing cutter, in which the anchor comprises at least one grip member which is displaced radially inward and outward by a respective mechanical linkage, and in which links of each respective mechanical linkage pivot in a plane that is laterally offset relative to a central longitudinal axis of the anchor;

deploying the anchor and the tubing cutter into the tubular string;

applying a tensile force from the anchor to the tubular string; and cutting the tubular string while the tensile force is applied from the anchor to the tubular string.

2. The method of claim 1, in which the tensile force applying comprises increasingly biasing the at least one grip member against an interior surface of the tubular string.

3. The method of claim 1, further comprising flowing a fluid through the anchor, thereby outwardly extending the at least one grip member from the anchor into contact with the tubular string.

4. The method of claim 3, further comprising inwardly retracting the grip member in response to a decrease in flow of the fluid through the anchor.

5. The method of claim 3, in which the fluid flowing further comprises creating a pressure differential across a piston of the anchor.

6. The method of claim 5, in which the piston is connected to each respective mechanical linkage, and in which the grip member outwardly extending further comprises each mechanical linkage outwardly extending a respective grip member in response to the pressure differential creating.

7. The method of claim 3, further comprising inwardly retracting the at least one grip member in response to increasing the tensile force to a predetermined level.

8. The method of claim 3, in which the at least one grip member comprises multiple grip members, and in which the outwardly extending further comprises the multiple grip members contacting the tubular string at a same longitudinal location along the tubular string.

* * * * *